US005154587A

United States Patent [19]

Mori et al.

[11] Patent Number: 5,154,587

[45] Date of Patent: Oct. 13, 1992

[54] MAGNET PUMP

[75] Inventors: Yozi Mori, Tokyo; Norishige Hirakawa, Mitsukaidou, both of Japan

[73] Assignee: World Chemical Co., Ltd., Tokyo, Japan

[21] Appl. No.: 581,017

[22] Filed: Sep. 12, 1990

[30] Foreign Application Priority Data

Feb. 14, 1990 [JP] Japan ..... 2-33514

[51] Int. Cl.[5] ..... F03B 11/06; F04D 13/02

[52] U.S. Cl. ..... 417/420; 417/423.8; 415/172.1; 415/104; 384/476; 384/320

[58] Field of Search ..... 417/214, 420, 423.1, 417/423.8, 423.12; 415/170.1, 172.1, 104, 107; 384/476, 317, 320

[56] References Cited

U.S. PATENT DOCUMENTS

| | | | |
|---|---|---|---|
| 3,332,252 | 7/1967 | Miller et al. | 417/420 |
| 3,411,450 | 11/1968 | Clifton | 417/420 |
| 3,513,942 | 5/1970 | Sato | 417/420 |
| 3,520,642 | 7/1970 | Fulton | 417/420 |
| 3,664,758 | 5/1972 | Sato | 415/104 |
| 4,047,847 | 9/1977 | Oikawa | 417/420 |
| 4,115,038 | 9/1978 | Litzenberg | 417/423.12 |
| 4,134,712 | 1/1979 | Kemmner et al. | 417/423.12 |
| 4,135,863 | 1/1979 | Davis et al. | 417/420 |
| 4,661,044 | 4/1987 | Freeland | 415/170.1 |
| 4,952,078 | 8/1990 | Ankenbauer et al. | 384/476 |
| 4,998,863 | 3/1991 | Klaus | 417/420 |
| 5,028,150 | 7/1991 | Kronenberger | 384/476 |
| 5,046,920 | 9/1991 | Higashi et al. | 384/476 |

FOREIGN PATENT DOCUMENTS

| | | | |
|---|---|---|---|
| 1-3328 | 1/1989 | Japan | 384/317 |

*Primary Examiner*—Richard A. Bertsch
*Assistant Examiner*—David L. Cavanaugh
*Attorney, Agent, or Firm*—Bauer & Schaffer

[57] ABSTRACT

A magnet pump is provided with a heat insulating member arranged between a shaft serving as the rotating axis and an impeller or a magnet can, heat conduction cut-off grooves on a heat conducting path, and a safety lock mechanism. These elements ensures to prevent frictional heat, even if generated due to abnormal operating conditions such as a non-load operation, from being conduted to parts with lower heat resistivity such as the impeller and the casing, deflection in rotation caused by looseness due to thermal expansion, and accordingly the magnet pump is protected from damages.

10 Claims, 7 Drawing Sheets

15
21
1d
2
13
51a
50a
51
9b
9a
50
11
10
53a
53
29
56a
56
6
20
8
54
12
54a
14
13
55a
19
17
3
55
16

MAGNET PUMP

BACKGROUND OF THE INVENTION

1. Field of the Invention

This invention relates to a magnet pump, and more particularly to a durable magnet pump which comprises means for removing heat typically generated during a non-load operation of the pump and thereby preventing damages possibly caused by such heat from occurring in elements of the pump made of plastic, rubber or the like.

2. Description of the Prior Art

For delivering liquid such as chemical liquid, a relatively low cost pump is utilized which comprises elements made of synthetic resin resistant to such chemical liquid. Since chemical liquid is treated, it is required that a shaft and a casing of the pump be completely sealed. This is because on many occasions such chemical liquid may be expensive and also hazardous to human body. Therefore, as a pump which meets the above requirement, there is known a magnet pump which does not have a shaft sealing member for sealing between the shaft and casing so as to avoid leakage of chemical liquid.

FIG. 1 shows a conventional magnet pump 1*a* as mentioned above. The magnet pump 1*a* comprises a casing 3 in which a fixed shaft 6 is accommodated. An impeller 8 is rotatably fitted on the shaft 6. A magnet can 10 is attached to the impeller 8 for accommodating a follower magnet 9*a* which is adapted to rotate the impeller 8 by transmitting rotations of a motor 28 (not shown in FIG. 1). Also, for rotating this magnet can 10, a driving magnet 9*b* is arranged in a rotating body 11 fitted on a rotating shaft 29 of the motor 28 at a position proximal to the casing 3. Thus, since the magnet pump 1*a* as constructed above does not have a shaft sealing member, chemical liquid introduced from an inlet port 20 is completely delivered to an outlet port 21 without any leakage from any part of the pump during a normal operation.

The shaft 6, serving as the rotating central axis for maintaining the rotation of the impeller 8, may be rubbed with the impeller 8 to generate frictional heat. Such frictional heat is cooled down by chemical liquid flow during a normal operation. However, if chemical liquid is not supplied from the inlet port 20 and the impeller 8 rotates without fluid flow, that is, during a non-load operation, the frictional heat is not cooled down and may cause problems, for example, deformation of synthetic resin members. Conventionally, prevention of the frictional heat, that is, the non-load operation of the magnet pump 1*a*, has been achieved by detecting a load current and stopping the magnet pump 1*a* by an electrical or pressure control method.

The conventional magnet pump 1*a* normally employs the impeller 8 and the magnet can 10 made of non-heat resistant material such as synthetic resin. These elements are therefore inherently susceptible to deformation by receiving heat. Also, the wall of the casing 3 is very thin and spacing between the casing and the magnet can 10 is quite narrow so as to obtain a large rotating force of the magnet can 10. Consequently, deformation of these elements causes a crash of the magnet can 10 and/or the impeller 8 with the casing 3, a crack in the casing which prevents the impeller from rotating, and so on, whereby the function of the pump may be lost ultimately.

The applicant has already provided a magnet pump which can eliminate the above-mentioned inconveniences (see Published Japanese Patent Application (Kokai) No. 63-264812), as illustrated in FIG. 2. In a magnet pump 1*b* shown, frictional heat is generated in portions A and B by the rotation of the impeller 8. To insulate such heat, the magnet pump 1*b* is provided with a rolling bearing 27 having heat insulating grooves 25, 27, . . . , a rear fixing bearing 4 having a heat insulating groove 4*a*, a front fixing bearing 5 having heat insulating grooves 5*a*, 5*b*, and a shaft 6 having heat insulating grooves 23, 24. The heat generated in the portions A, B is therefore diffused by the heat insulating grooves formed on these bearings 4, 5, 6 and 26 and insulated from the casing 3, the impeller 8, the magnet can 10 and so on, making it possible to prevent deformation, crash and crack from occurring in these elements.

However, even with the magnet pump 1*b* of the applicant, if it is left in unfavorable operating conditions such as non-load operation, cavitation operation, shut-out operation, insufficient load operation (insufficient priming), air lock operation, over-feeding, unstable feeding conditions caused by prerotation effects and so on (these operations or conditions are hereinafter represented by "the non-load operation") for a long period and if such conditions are detected too late, the heat generated in the portions A, B is gradually accumulated therein and conducted to the magnet can 10, the impeller 8 and the casing 3. As a result, the temperature is increased to cause deformation of these elements. Further, such deformation leads to a slack for a short time period between the casing 3 and the shaft 6 and between the rolling bearing 7 and the impeller 8 and/or the magnet can 10. Also, the rotation of the impeller 8 and the magnet can 10 may be deflected, and therefore these elements come into contact with the casing 3, whereby the casing 3 is cracked or deformed. In the worst case, it can be thought that the impeller 8 is stopped, chemical liquid leaks through cracks in the casing 3, and the function performed as the magnet pump will be lost.

OBJECTS AND SUMMARY OF THE INVENTION

In view of the problems mentioned above, it is an object of the present invention to provide a magnet pump which can eliminate deformation of its elements such as a casing and an impeller, caused by a non-load operation of the pump or the like, and inoperable conditions resulting from cracks formed in a casing, while maintaining a high resistivity to acid and alkaline chemicals.

To achieve the above object, the present invention provides a magnet pump which comprises:

an impeller rotatably fitted on a shaft accommodated and fixed in a casing; and a rolling bearing and a heat insulating member disposed between the shaft and the impeller and provided with heat conduction cut-off grooves.

The above and other objects, features and advantages of the present invention will become more apparent from the following detailed description when taken in conjunction with the accompanying drawings in which preferred embodiments of the present invention are shown by way of illustrative examples.

DETAILED DESCRIPTION OF THE PREFERRED EMBODIMENT

Figure 1:
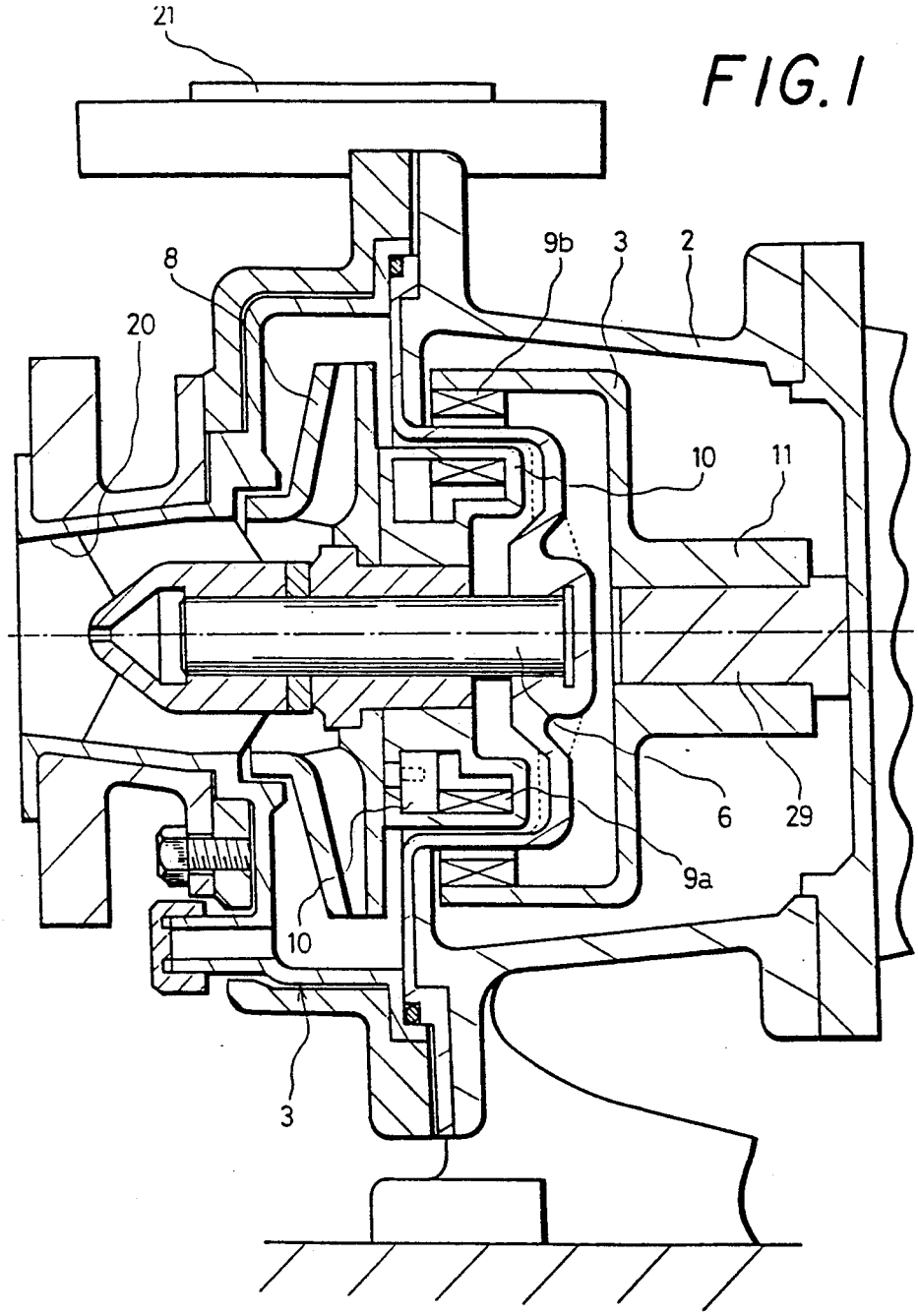
FIGS. 1 and 2 are longitudinal sectional views respectively showing a prior art magnet pump.
Figure 2:
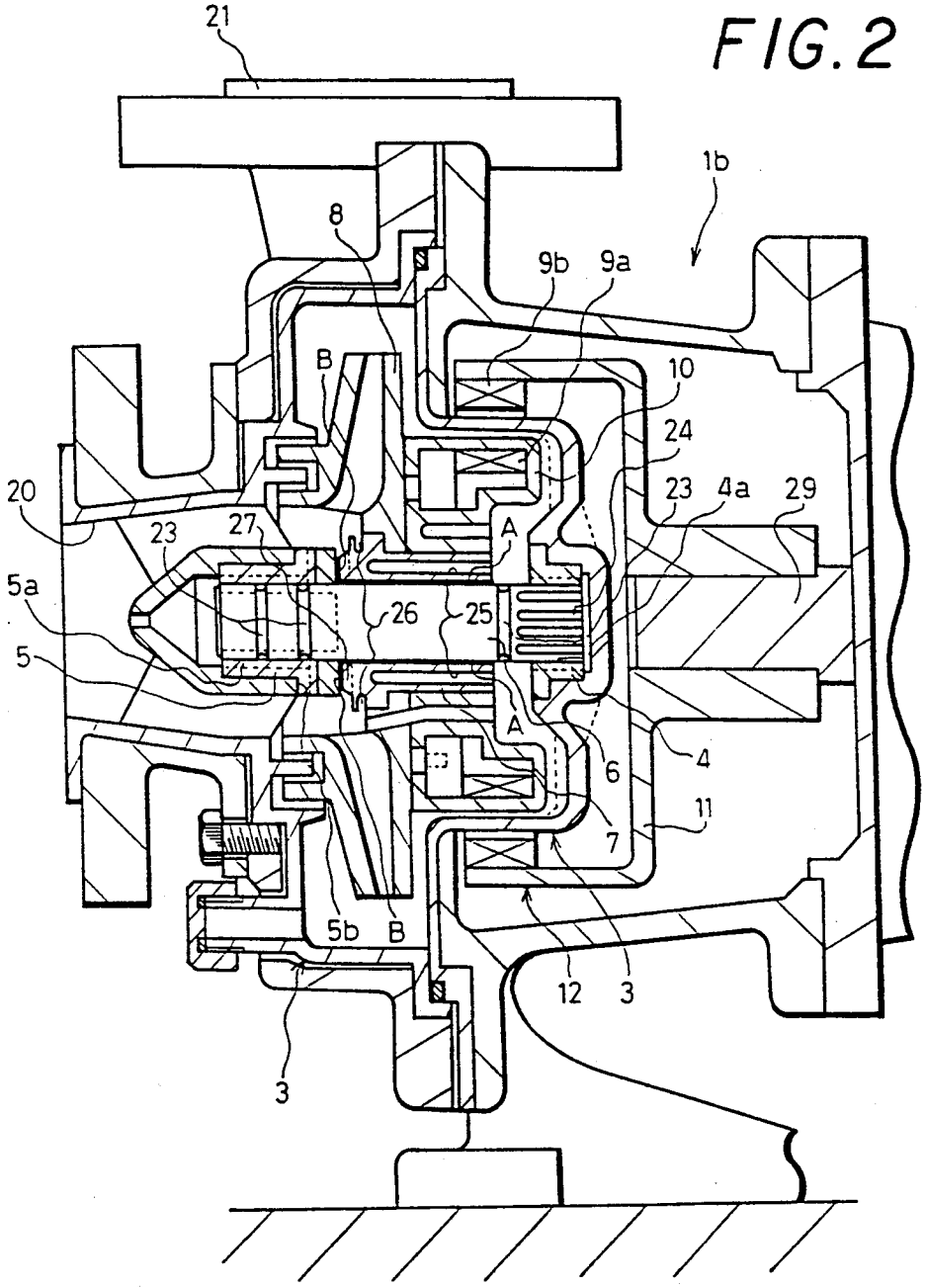

A first embodiment of the present invention will hereinafter be explained with reference to FIG. 3. A magnet pump 1 includes a housing 2 and a casing 3 which is accommodated in the housing 2. A shaft 6 is accommodated in the casing 3 and fixed by rear and front fixing bearings 4, 5. An impeller 8 is rotatably provided on the shaft 6 through a rolling bearing 7 and a heat insulating member 40 fitted on the outer periphery of the rolling bearing 7. A safety lock 30 is provided between the impeller 8 and the casing 3 for safely locking the pump when a malfunction occurs. A driving section 12 includes a magnet can 10, fixed to the impeller 8, for accommodating a follower magnet 9*a* and a rotating body 11, arranged outside the casing 3, for accommodating a driving magnet 9*b* for rotating the impeller 8 together with the follower magnet 9*a* in the magnet can 10.

The housing 2 comprises a motor bracket 13, a suction flange 14 and a discharge flange 15 and is arranged to accommodate and hold the casing 3. These elements can respectively be secured by bolts or the like. Since the housing 2 does not directly contact with chemical liquid, the mechanical intensity is considered more important than the resistivity to chemicals, so that a molded housing is normally employed as the housing 2.

The material for the casing 3 is selected with due regard to the resistivity to chemical liquid. Specifically, the casing 3 is made of synthetic resin, for example, polypropylene, fluororesin, or the like. Also, the casing 3 is formed of a rear casing 16 and a front casing 17 which are tightly coupled to each other through a seal member 19 so as to provide a complete fluid tight structure. The front casing 17 is provided with a suction port 20 and a discharge port 21. Further, the rear and front casings 16, 17 are provided with fixing grooves 16*a*, 17*a*, respectively, to which rear and front fixing bearings 4, 5 are fixed, respectively.

These rear and front fixing bearings 4, 5 are provided with heat conduction cut-off grooves 4*a*, 5*a* formed thereon, respectively, which are adapted, as will be explained later in detail, to cut off conduction of frictional heat generated by friction between the shaft 6 and the rolling bearing 7 and friction between the rolling bearing 7 and a front thrust bearing 22, later referred to, and prevent such frictional heat from being conducted to the rear casing 16 and the front casing 17. It should be noted that the front fixing bearing 5 is provided with a liquid introducing path 5*b* and a heat discharging hole 5*c*, so that the distance from the shaft 6 to the front casing is relatively long and accordingly the surface area thereof is large enough to promote frictional heat to diffuse therefrom.

Incidentally, the rear and front fixing bearings 4, 5 may be made of a porous material such as ceramics. The porous material, which contains a large quantity of air, serves to cut off heat conduction and accordingly prevent the above-mentioned frictional heat from being conducted.

The rear fixing bearing 4 and the front fixing bearing 5 are made of a resin having a higher heat resistivity than the rear and front casings 16, 17, i.e., a resin, the heat distortion temperature of which is 180° C. or more. The bearings 4, 5 are attached to the shaft 6 by shrink fitting so as to provide a loosening preventing mechanism. Therefore, even if the rear and front fixing bearings 4, 5 are heated to a high temperature by frictional heat, they will not be deformed so easily because of their heat resistant material. Also, since they are shrink fitted, they will not become loose on the shaft 6 even with thermal expansion. Thus, it is ensured that the bearings 4, 5 will not become shaky with the shaft 6.

The shaft 6 has its opposite end portions supported by the rear and front fixing bearing 4, 5 and provides the center of rotation for the impeller 8 and the magnet can 10 in which the follower magnet 9*a* is accommodated. The shaft 6 is made of a hard chemical resistant material, for example, alumina ceramics. The outer peripheral surface of the shaft 6 is provided with a plurality of circular heat conduction cut-off grooves in the radial direction. Also the rear side outer peripheral surface of the shaft 6 is provided with a spline type heat conduction cut-off groove in the axial direction. These heat conduction cut-off grooves performs in a similar manner to the foregoing heat conduction cut-off grooves 4*a*, 5*a*. Specifically, they prevent the aforementioned frictional heat from being conducted to the rear and front casings 16, 17 through the rear and front fixing bearings 4, 5.

The impeller 8 and the magnet can 10 are rotatably fitted on the shaft 6 through the rolling bearing 7 and the heat insulating member 40. Further, a front thrust bearing 22 and a rear thrust bearing 41 are respectively fixed at its axially opposite ends of the rolling bearing for supporting the thrust load of the impeller 8 and the magnet can 10. The rear and front thrust bearings 22, 41 are made of ceramics, and the load of the rear and front thrust bearings 22, 41 in the thrust direction is received by the front and rear fixing bearing 4, 5 through buffer members 42, 43 which are made of a shock softening material such as rubber and provided with heat conduction cut-off grooves 42*a*, 43*a*, respectively.

The rolling bearing 7 is cylindrical and provided with a collar. It is rotatably and slidably fitted on the shaft 6 and adapted to rotate together with the impeller 8 and the magnet can 10. A cylindrical portion of the rolling bearing 7 is provided with substantially concentric heat conduction cut-off grooves 25 in the axial direction. The heat insulating member 40 fitted on the outer periphery of the rolling bearing 7 is made of porous material and provided with substantially concentric heat conduction cut-off grooves 40*a* in a similar manner to the rolling bearing 7. These rolling bearing 7 and heat insulating member 40 have a double structure in a similar manner to a thermal bottle. Specifically, the double structure of the rolling bearing 7 and heat insulating member 40 is formed by the heat conduction cut-off grooves 25, 40*a*, respectively, such that the conduction of frictional heat generated by the aforementioned friction is prevented by means of an air layer having a low heat conductivity in the heat conduction cut-off grooves 25, 40*a* and the heat insulating property of the heat insulating member 40, whereby the frictional heat is not conducted to the casing 3, the impeller 8 and the magnet can 10. Further, rotations of these heat conduction cut-off grooves 25, 41*a* cause the air existing therein to be agitated, so that frictional heat reaching the surface of the heat conduction cut-off grooves 25, 41*a* are diffused. Incidentally, since the heat insulating member 40 is not integrated with the rolling bearing 7, it is possible to arbitrarily choose material having a high heat insulating property irrespective of the material required to the rolling bearing 7.

The heat insulating member 40 is made of a material having a higher heat resistivity than that of the magnet can 10, for example, a resin, the heat distortion temperature of which is 180° or more, and is shrink fitted on the shaft 6 for providing a looseness preventing mechanism. Therefore, even if a high temperature is generated by frictional heat in the heat insulating member 40, it will not suffer from distortion because of the highly heat resistant material employed, and also by virtue of shrink fitting they will not become loose on the shaft 6 even with thermal expansion. Thus, it is ensured that the bearings 4, 5 will not be shaky with the rolling bearing 7.

The impeller 8 is of non-clogging type and made of material which is selected sufficiently taking consideration of resistivity to chemicals and intensity. Generally, a synthetic resin, for example, polypropylene, fluororesin, or the like is employed.

Figure 4:
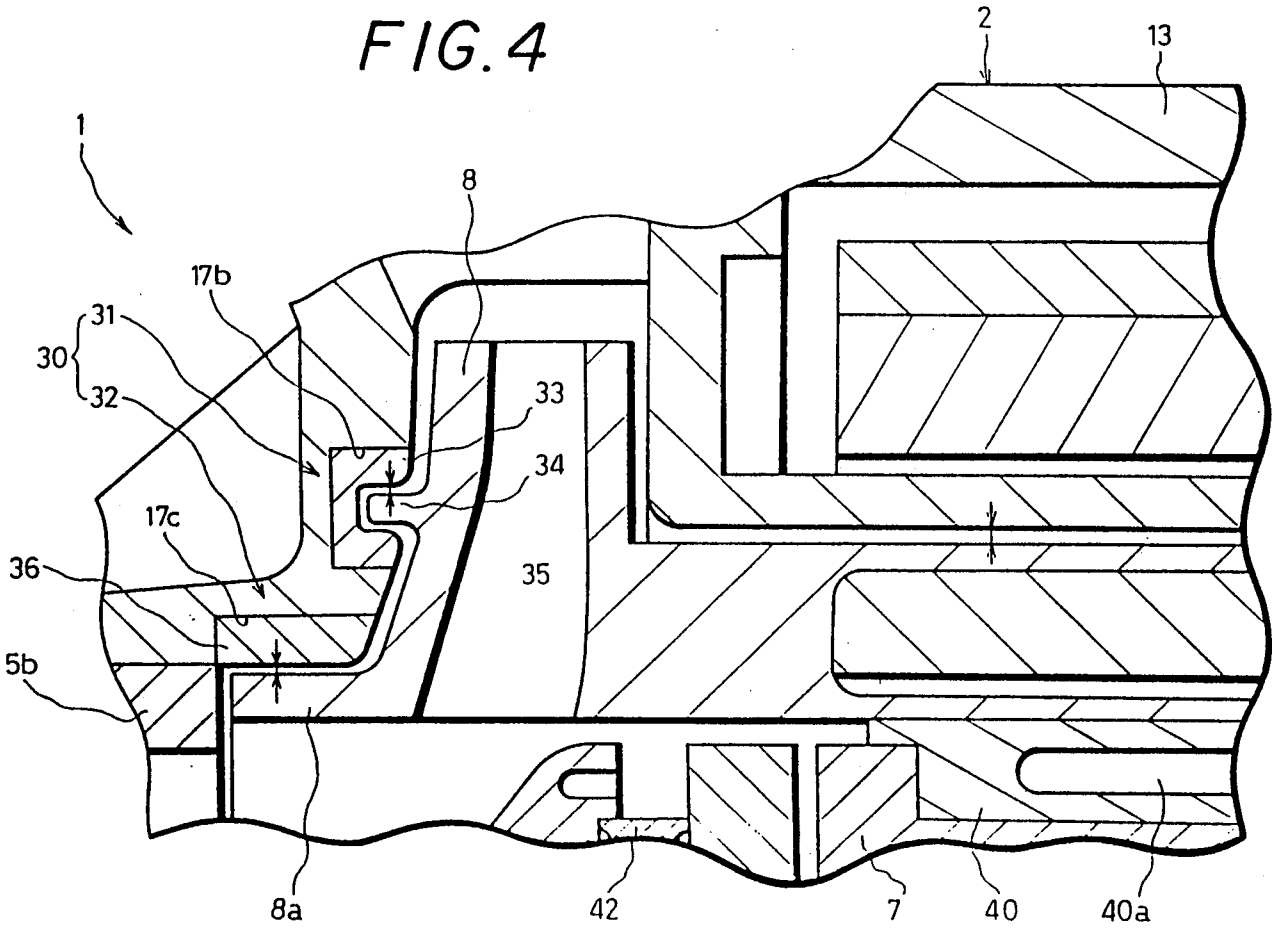
FIG. 4 is an enlarged sectional view illustrating a main portion of the magnet pump shown in FIG. 3.

The safety lock 40 comprises a main lock 31 and an auxiliary lock 32, as shown in FIG. 4. The main lock 31 has a main bush 33 removably fitted in a ring-shaped groove 17*b* formed on the front casing 17, and a protrusion 34 attached to the impeller 8 so as to be rotatable in a ring groove 35 of the main bush 33. The ring groove 35 of the main bush 33 and the protrusion 34 are arranged to be mainly engaged with each other to lock the pump. On the other hand, the auxiliary lock 32 has an auxiliary bush 36 removably fitted in a L-shaped groove 17*c* formed on the front casing 17, wherein the auxiliary bush 36 and a protrusion 8*a* at the tip of the impeller 8 are also engaged with each other to additionally lock the pump.

These main lock 31 and auxiliary lock 32 are provided to lock the pump before the casing 3 come into contact with the magnet can 10 and the impeller 8 when a deflection a in rotation of the impeller 8 and the magnet can 10 exceeds a predetermined amount ($\gamma$ or $\delta$, which will be explained later). Such deflection in rotation is typically caused by abnormal friction caused by sliding of the shaft 6 and the rolling bearing 7, thermal distortion of the rear and front fixing bearings 4, 5, and thermal distortion of the heat insulating member 40 carrying the rolling bearing 7. More specifically, when a deflection $\alpha 1$ in rotation of the magnet can 10 and the impeller 8 reaches a predetermined amount $\gamma$ which is smaller than a minimum gap $\beta$ between the inner wall surface of the casing 3 and the magnet can 10 or the impeller 8 ($\alpha 1=\gamma<\beta$), the main lock 31 is operative to lock the pump.

The auxiliary lock 32 is adapted to supplementarily lock the pump when a deflection $\alpha 2$ in rotation of the magnet can 10 and the impeller 8 reaches a predetermined amount $\gamma$ which is smaller than a minimum gap $\beta$ between the inner wall surface of the casing 3 and the magnet can 10 or the impeller 8, however, the main lock 32 does not operate, and eventually the deflection $\alpha 2$ reaches a predetermined value $\delta$ which is smaller than the minimum gap $\beta$ ($\alpha 1=\gamma<\alpha 2=\delta<\beta$).

The main bush 33 of the main lock 31 and the auxiliary bush 36 of the auxiliary lock 32 are made of wear-resistant material and replaced when they are worn by a predetermined amount.

The safety lock 30 is not limited to be located at the place selected by the present embodiment and may be located at any other suitable place.

The driving section comprising the magnet can 10 and the rotating body 11 is adapted to rotate the impeller 8. The rotating body 11 is coupled to the shaft 29 of the motor 28 supported by a motor bracket 13. Therefore, rotation of the shaft 29 of the motor 28 causes the driving magnet 9*b* accommodated in the rotating body 11 to be also rotated. Rotation of the driving magnet 9*b* incurs rotation of the follower magnet 9*a*, whereby the magnet can 10 and also the impeller 8 are rotated. In such construction, it is necessary, for obtaining a stronger torque, to enhance a magnetic force between the driving magnet 9*b* and the follower magnet 9*a*. For this purpose, a gap between the two magnets 9*a*, 9*b* is formed as narrow as possible. Specifically, the aforementioned gap $\beta$ between the inner wall surface of the rear casing 16 and the outer surface of the magnet can 10 is approximately 2–3 m/m.

Next, reference is made to the operation of the magnet pump 1 constructed as described above.

Figure 3:
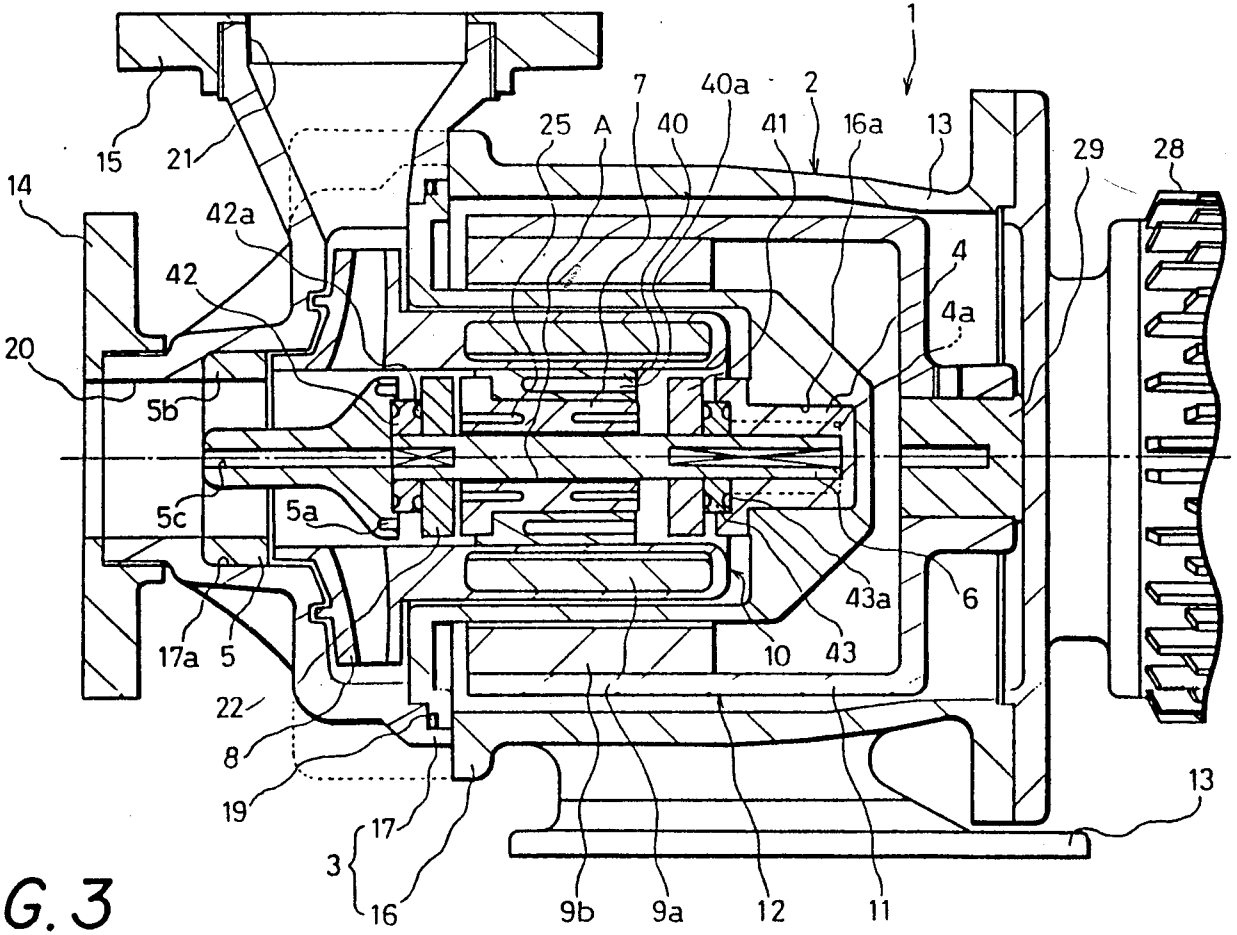
FIG. 3 is a longitudinal sectional view showing a first embodiment of a magnet pump according to the present invention.

The magnet pump 1, as shown in FIG. 3, has a spacing between the rotating shaft 7 and the front and rear thrust bearings 22, 41. In an inoperative state, the follower magnet 9*a* is attracted and fixed by the driving magnet 9*b* with the spacing maintained. The magnetic pump 1 has the casing 3 normally filled with chemical liquid or the like. The chemical liquid is fed from the suction port 20 into the casing 3 and discharged from the discharge port 21 after being given a predetermined pressure by the impeller 8. In this event, the opposite ends of the shaft 6 are fixed to the casing 3 through the rear and front fixing bearings 4, 5. The front and rear thrust bearings 22, 41 are supported by the front and rear fixing bearings 4, 5 through buffer members 42, 43, respectively. Further, the impeller 8 and the magnet can 10 are rotated about the shaft 6 through the heat insulating member 40 and the rolling bearing 7, so that the impeller 8 obtains a thrust on the front side while the rolling bearing 7 is rotated about the shaft 6 and the front thrust bearing 22 in a sliding manner, whereby frictional heat is generated therebetween. However, in a normal operating condition as mentioned above, such frictional heat is cooled down by the chemical liquid filling the casing 3, thus avoiding damages caused by the frictional heat.

However, if the casing 3 is not filled with chemical liquid due to an accident, power failure or the like, that is, in a non-load operating condition, the magnetic pump 1 is not provided with chemical liquid serving as coolant nor the above-mentioned thrust toward the front side so that the rolling bearing 7 does not come into contact with the front and rear thrust bearings 22, 41, whereby frictional heat is generated in a sliding portion A between the shaft 6 and the rolling bearing 7 to cause a high temperature therein. This high temperature frictional heat generated in the sliding portion A is mainly conducted to the impeller 8 and the magnet can 10 through the rolling bearing 7 and the heat insulating member 40, however, is substantially prevented from being conducted by the double structure for heat insulation mainly formed by the heat conduction cut-off groove 25 of the rolling bearing 7 and the heat conduction cut-off groove 40*a* of the heat insulating member 40. The high temperature frictional heat reaching the surface of the heat conduction cut-off grooves 25, 40*a* is converted from conduction to convection, and further surrounding air is agitated by rotation of these grooves, whereby the high temperature frictional heat on the surface of the heat conduction cut-off grooves 25, 40*a* is cooled down by the agitated air. In addition, since the heat insulating member 40 is separated from the rolling bearing 7, as mentioned above, the member is made of a material having a high heat insulating property so that the frictional heat is more efficiently insulated.

Further, the high temperature frictional heat generated in the sliding portion A is mainly conducted to the shaft 6, the front fixing bearing 5 and the front casing 17, respectively, however, is substantially prevented from being conducted by the heat conduction cut-off groove of the shaft 6, the heat conduction cut-off groove 5*a* of the front fixing bearing 5, the liquid introducing path 5*b*, the heat discharging hole 5*c* and the heat conduction cut-off groove 43*a* of the buffer member 42. Specifically, since the size of the front fixing bearing 5 is large and also the surface area thereof is rendered considerably large because of the liquid introducing path 5*b*, the heat discharging hole 5*c* and the heat conduction cut-off groove 5*a*, the high temperature frictional heat reaching the surface of these elements is converted from conduction to convection. Further, surrounding air is agitated by rotation of the impeller 8, whereby the high temperature frictional heat on the surface of the above elements is cooled down by air.

As described above, the high temperature frictional heat generated in the sliding portion A is prevented from being conducted to the impeller 8, the magnet can 10 and the front casing 17, whereby these elements will never suffer from thermal distortion which may be otherwise caused by such frictional heat.

The high temperature frictional heat generated in the sliding portion A also tends to be conducted to the rear casing 16 of the casing 3 through the shaft 6 and the fixing bearing 4. However, the heat conduction cut-off groove formed on the shaft 6 and the heat conduction cut-off groove 4*a* formed on the rear fixing bearing 4 substantially insulate the conduction of the frictional heat. More specifically, by virtue of the double structure such as thermal bottle made up of the heat conduction cut-off grooves provided for the shaft 6 and the rear fixing bearing 4, the frictional heat is converted from a conduction form to a convection form, or the frictional heat cannot be conducted easily. Thus, the high temperature frictional heat is hardly conducted to the rear casing 16 which will never be distorted thereby.

Nevertheless, if the aforementioned non-load operation or other unfavorable operating conditions continue for a long time, the rear and front fixing bearings 4, 5, respectively provided with the looseness preventing mechanism, and the heat insulating member 40 are also heated and thermally expanded. The rear and front fixing bearings 4, 5 and the heat insulating member 40 are shrink fitted on the shaft 6 and the rolling bearings 7 whose thermal expansion is relatively small, so that looseness and backlash will never occur among these elements. Therefore, the impeller 8 and the magnet can 10 are substantially protected from making contact with the casing 3, making it possible to avoid damages and cracks in these rotating elements. Also, the rear and front fixing bearings 4, 5 and the heat insulating member 40, since they are made of heat resistant material, will never suffer from thermal distortion.

Even in normal operating conditions, the rolling bearing 7, the shaft 6 and the front thrust pad 22 are subjected to abrasion irrespective of the presence or absence of chemical liquid. Such aging change due to abrasion may cause deflection in rotation of the impeller 8 and the magnet can 10.

If the aforementioned looseness preventing mechanism is not provided, a long time unfavorable operation such as non-load operation may cause thermal expansion in the rear and front fixing bearings 4, 5 and the heat insulating member 40 which become loose on the shaft 6 and the rolling bearing 7 which have lower coefficients of thermal expansion than the elements 4, 5 and 40. The looseness of these elements results in deflection in rotation of the impeller 8 and the magnet can 10. If the deflection $\alpha$ reaches the predetermined amount $\gamma$, the main lock 31 of the safety lock 30 is operated. More specifically, the ring groove 35 of the main bush 25 arranged on the front casing 17 comes in contact with the protrusion 34 of the impeller 8 to lock the pump. Further, if the main lock 31 is not operated for some reason, and if the deflection $\alpha$ reaches the predetermined amount $\delta$, the auxiliary lock 32 is operated. More specifically, the auxiliary bush 36 arranged on the front casing 17 comes in contact with the protrusion 8*a* at the tip of the impeller 8 to lock the magnet pump 1. It is therefore possible to detect malfunction of the magnet pump 1 before the impeller 8 and/or the magnet can 10 come in contact with the casing 3, any of these elements is cracked, and chemical liquid leaks through thus formed cracks.

Figure 5:
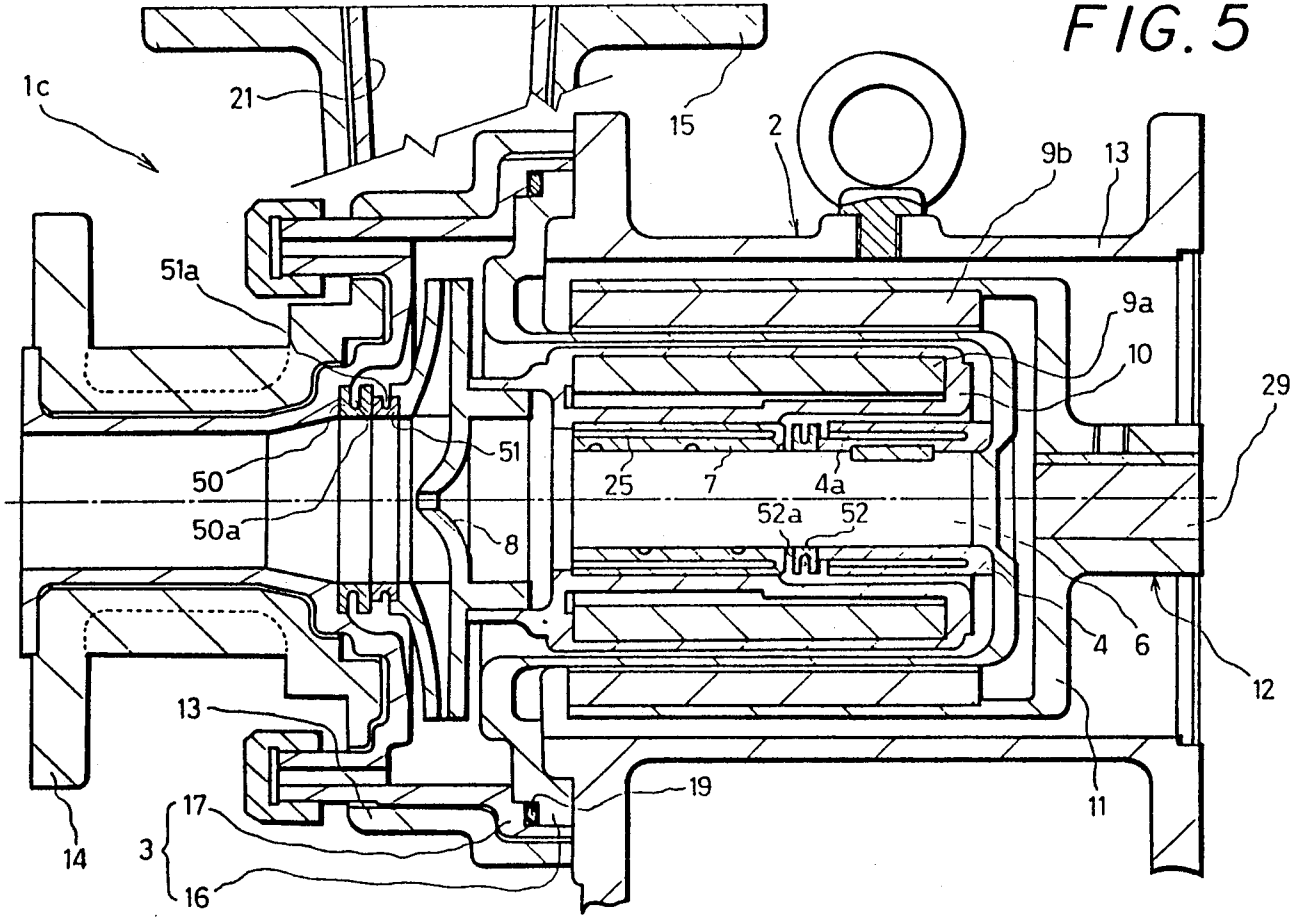
FIGS. 5, 6 and 7 are longitudinal sectional views showing other embodiments of the present invention.

FIG. 5 shows a second embodiment of a magnet pump 1*c* of the present invention, in which the parts corresponding to those in FIG. 3 are designated the same reference numerals and the detailed explanation thereof will be omitted. The magnet pump 1*c* does not have the front fixing bearing 5 as shown in FIG. 3, and the shaft 6 is cantilevered by the rear fixing bearing 4. For this construction, the front casing 17 is provided with a thrust bearing ring 50 provided with a heat conduction cut-off groove 50*a*. Also a mouth ring 51, provided with a heat conduction cut-off groove 51*a*, is attached to the impeller 8 so as to be slidable on the thrust bearing ring 50. In the magnet pump 1*c*, due to such construction, frictional heat is generated between the thrust bearing ring 50 and the mouth ring 51 and between the shaft 6 and the rolling bearing 7. Such frictional heat is hardly conducted due to the double structure formed by the heat conduction cut-off grooves 50*a*, 51*a* and diffusion of heat by the rotation of the impeller 8, which protects the casing 3 and the impeller 8 from being thermally distorted. The remaining construction and actions of the second embodiment are substantially identical to those of the first embodiment shown in FIG. 3, so that the detailed explanation thereof will be omitted. Incidentally, reference numeral 52 in FIG. 5 designates a ring provided with a heat conduction cut-off groove 52*a* for diffusing frictional heat generated between the shaft 6 and the rolling bearing 7.

Figure 6:
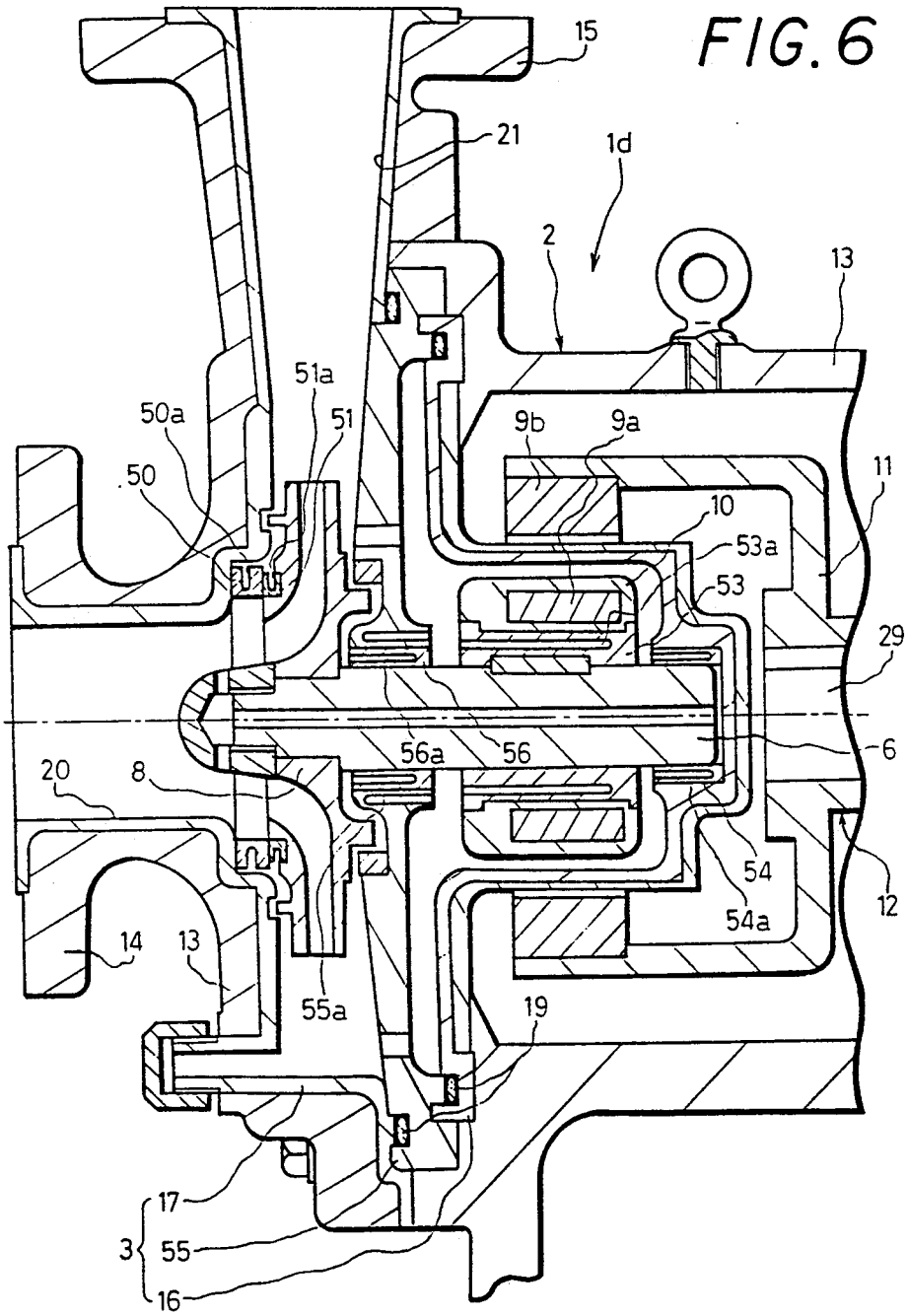

FIG. 6 shows a third embodiment of the present invention. A magnet pump 1*d* illustrated in FIG. 6 differs from the first embodiment in FIG. 3 in the following construction. First, the shaft 6 is rotatably mounted to the casing 3 through a rear rolling bearing 54 and a front rolling bearing 56 attached to a split plate 55 and fixed to the magnet can 10 through the impeller 8 and the fixing bearing 53. Secondly, the front casing 17 is provided with a thrust bearing ring 50, and a mouth ring 51 is mounted on the impeller 8 so as to be slidably contacted to the thrust bearing ring 50. Also, these fixing bearing 53, rear rolling bearing 54, split plate 55, front rolling bearing 56, thrust bearing ring 50 and mouth ring 51 are provided with heat conduction cut-off grooves 53*a*, 54*a*, 55*a*, 56*a*, 50*a* and 51*a*, respectively.

In the magnet pump 1*d*, frictional heat is generated between the thrust bearing ring 50 and the mouth ring 51, between the shaft 6 and the front rolling bearing 56 and between the shaft 6 and the rear rolling bearing 54, respectively. However, such frictional heat is hardly conducted due to the double structure or the principle of thermal bottle, formed by the heat conduction cut-off grooves 53*a*, 54*a*, 55*a*, 56*a*, 50*a* and 51*a*, and thermal diffusion caused by the rotation of the impeller 8, whereby the rear and front casings 16, 17, the split plate 55, the magnet can 10 and the impeller 8 are protected from being thermally distorted. The remaining construction and actions of the third embodiment are substantially identical to those of the first embodiment shown in FIG. 3, so that the parts corresponding to those in FIG. 3 are designated the same reference numerals and the detailed explanation thereof will be omitted.

Figure 7:
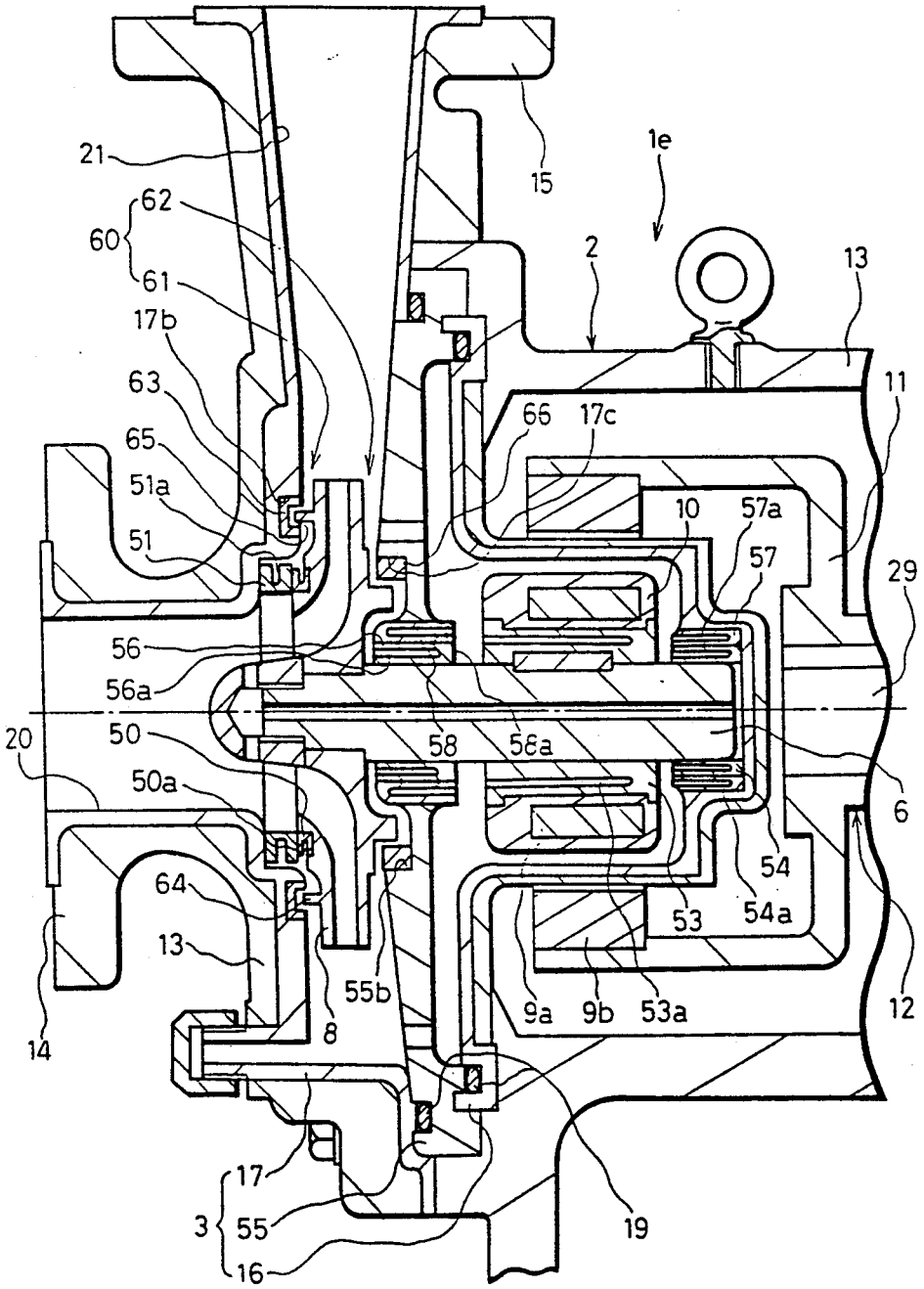

FIG. 7 shows a fourth embodiment of the present invention. A magnet pump 1*e* differs from the magnet pump 1*d* illustrated in FIG. 6 in that the former is provided with a looseness preventing mechanism and a safety lock mechanism. Specifically, this looseness preventing mechanism is formed of a heat insulating members 57, 58 arranged between the rear casing 16 and the rear rolling bearing 54 and between the split plate 57 and the front rolling bearing 56, respectively. The heat insulating members 57, 58 and the fixing bearing 53 are made of a material having a higher heat resistivity than those of the rear casing 16, the split plate 55 and the magnet can 10, the thermal distortion temperature of which is 180° C. or more, and shrink fitted on the shaft 6.

The safety lock mechanism comprises a safety locks 60 arranged between the casing 3 and the magnet can 10 and/or between the casing and the impeller 8. The safety lock 60 is made up of a main lock 61 and an auxiliary lock 62. The main lock 61 has a main bush 63 removably fitted in the ring-shaped groove 17*b* formed on the front casing 17, and a protrusion 64 attached to the impeller 8 so as to be rotatable in a ring groove 65 of the main bush 33. The ring groove 65 of the main bush 63 and the protrusion 64 are arranged to be mainly engaged with each other to lock the pump. On the other hand, the auxiliary lock 62 has an auxiliary bush 66 removably fitted in a L-shaped groove 55*c* formed on the split plate 55, wherein the auxiliary bush 66 and a protrusion 8*b* at the tip of the impeller 8 also are engaged with each other to additionally lock the pump. The rest of the construction and the actions of the fourth embodiment are substantially equivalent to the aforementioned embodiments illustrated in FIGS. 3, 4 and 6, so that corresponding parts are designated the same reference numerals and the detailed explanation thereof will be omitted.

As described above in detail, according to the magnet pump of the present invention, even if an impeller is under an unstably pressurized condition due to a malfunction, frictional heat generated by friction between a rolling bearing rotating with the impeller and a shaft is prevented from being conducted by the principle of thermal bottle, that is, the double structure formed by heat conduction cut-off grooves on the rolling bearing, and an air layer in the heat conduction cut-off grooves with a low heat conductivity. Further, the rotation of the rolling bearing causes agitation of air, which promotes the frictional heat to be diffused, whereby the heat is hardly conducted to the impeller and other elements which are thus protected from thermal distortion. Also, provision of the heat conduction cut-off grooves on the heat insulating member is effective in diffusing the frictional heat by the above-mentioned double structure and agitated air, and in addition, the heat insulating property of a heat insulating member itself further inhibits the heat from being conducted. It is therefore possible to prevent the magnet pump from falling into inoperative conditions such as a rotation impossible condition due to a contact between, for example, the impeller and the casing, and a hole or crack in the casing.

When a front side fixing bearing is separately provided between the casing and the shaft, frictional heat generated between the rolling bearing and the shaft is diffused from heat discharging holes and a liquid introducing path. Also, since the distance to the casing is relatively long, the frictional heat is diffused from other surfaces of the front side fixing bearing. Thus, the frictional heat is further prevented from being conducted to the casing and other elements made of synthetic resin. In addition, the heat conduction cut-off grooves, if formed on the front side fixing bearing, provides the aforementioned double structure and air agitation which further promotes diffusion of the frictional heat, and accordingly the same effects can be produced.

When thrust bearings are arranged at the opposite axial ends of the rolling bearing with a predetermined spacing therebetween, and buffering members are arranged between the respective fixing bearings supporting the opposite ends of the shaft and the respective thrust bearings, a thrust is not produced in the impeller in a non-load operation so that the rolling bearing and the thrust bearings do not slide, whereby the frictional heat is generated only between the rolling bearing and the shaft. In a normal operation, a transition from a normal operation to a non-load operation and a transition from a non-load operation to a normal operation, the rolling bearing hits against the thrust bearing, however, a shock generated thereby is softened by the buffering members. Therefore, frictional heat is generated from less parts, and correspondingly the above effects can be more easily produced.

Further, by providing the casing with a thrust bearing ring provided with a heat conduction cut-off groove and a mouth ring provided with a heat conduction cut-off groove which is arranged slidable along the thrust bearing ring, frictional heat is diffused by a double-structure formed by the heat conduction cut-off grooves on the thrust bearing ring and the mouth ring and effects of agitated air, thereby producing the same effects as the above.

In unfavorable operating conditions such as non-load operation, the fixing bearing and the heat insulating member are thermally expanded by frictional heat generated between the rolling bearing and the shaft. However, since the fixing bearing and the heat insulating member are shrink fitted on the shaft and the rolling bearing, the former elements do not become loose on the latter elements, and therefore backlash will not occur. This advantageous feature prevent the impeller and the magnet can from hitting against the casing, whereby damage and/or crack will not occur in them, which results in preventing leakage of chemical liquid and inoperative conditions of the magnet pump.

In a magnet pump which has a magnet can accommodated in a casing and rotatably attached to a fixed shaft for rotating an impeller, thermal distortion, abrasion and so on caused by frictional heat results in deflection in rotation of the magnet can and the impeller. When such deflection is increased to reach a predetermined amount less than a gap between the inner wall of the casing and the magnet can and/or the impeller, a safety lock is operated to prohibit the rotation of the magnet can, whereby the magnet can and the impeller do not come in contact with the casing. Thus, contact of the impeller and the magnet can with the casing and subsequent damage and crack are avoided even if inevitable deflection in rotation occur, making it possible to prevent damage caused by leakage of chemical liquid and inoperative conditions of the magnet pump.

In addition, a type of a magnet pump in which the shaft is rotated together with the impeller has the same effects as mentioned above.

We claim:

1. In a magnet pump having a fixed shaft, an having an impeller, a roller bearing, and a magnet rotataly fitted on a fixed shaft within a casing so as to rotate said impeller mechanism for preventing looseness, comprising:

a heat insulating member made of a material having a higher heat resistivity than said casing, said heat insulating member being shrink fitted on said rolling bearing at a position between said casing and said rolling bearing; and a fixing bearing made of a material having a higher heat resistivity than said magnet can, said fixing bearing being shrink fitted on said shaft at a position between said shaft and said magnet can.

2. A magnet pump comprising a casing, a shaft located in said casing, an impeller rotatably supported about said shaft, an impeller support assembly interposed between said shaft and said impeller, said support assembly comprising a rolling bearing having heat conduction cut-off grooves formed therein and a heat insulating member arranged about the periphery of said rolling bearing and thrust bearings mounted on said shaft at each of the axial ends of said rolling bearing, said thrust bearing being spaced from said rolling bearing so as to provide a gap therebetween when said impeller is driven.

3. The magnet pump according to claim 2, wherein said insulating member is provided with heat conduction cut-off grooves.

4. The magnet pump according to claim 2, including a first fixing bearing inserted into said casing at the front end thereof and said fixing bearing having a liquid introducing path between said casing and said shaft and said fixing bearing is provided with a heat discharging hole.

5. The magnet pump according to claim 4, including a second fixing bearing inserted at the rear end of said shaft, said front fixing bearing and said rear fixing bearing being provided with heat conduction cut-off grooves.

6. The magnet pump according to claim 2, including buffering member arranged between said thrust bearings and said first and second fixing bearings respectively for supporting both end portions of said shaft.

7. The magnet pump according to claim 4, wherein said buffering member is provided with heat conduction cut-off grooves.

8. The magnet pump according to claim 5, including a magnet can mounted in said impeller, and wherein said fixing bearings are made of a material having a higher heat resistivity than said casing and are shrink fitted on said shaft, and said heat insulating member is made of a material having a higher heat resistivity than said magnet can, said heat insulating member being shrink fitted on said rolling bearing between said rolling bearing and said magnet can.

9. The magnet pump according to claim 2, further comprising safety lock means disposed on said impeller and said casing for prohibiting rotation of said magnet can, said safety lock means being effective when rotative deflection of said magnet can and said impeller reaches a predetermined amount, less than a gap between the inner wall of said casing and said magnet can.

10. The magnet pump according to claim 9, wherein said safety lock means is arranged between said magnet can and said casing.

* * * * *